United States Patent [19]

Narita et al.

[11] Patent Number: 4,527,615

[45] Date of Patent: Jul. 9, 1985

[54] ELECTROMAGNETIC WITHIN-MOLD STIRRING METHOD OF HORIZONTAL CONTINUOUS CASTING AND AN APPARATUS THEREFOR

[75] Inventors: Kiichi Narita, Kobe; Takasuke Mori, Ashiya; Kenzo Ayata, Kobe; Jun Miyazaki, Kobe; Takahiko Fujimoto, Kobe; Hitoshi Nakata, Toyonaka, all of Japan

[73] Assignee: Kabushiki Kaisha Kobe Seiko Sho, Kobe, Japan

[21] Appl. No.: 469,709

[22] Filed: Feb. 25, 1983

[30] Foreign Application Priority Data

Feb. 27, 1982 [JP] Japan ..... 57-31510

[51] Int. Cl.[3] ..... B22D 11/10; B22D 27/02

[52] U.S. Cl. ..... 164/468; 164/440; 164/490; 164/504

[58] Field of Search ..... 164/468, 504, 490, 440

[56] References Cited

U.S. PATENT DOCUMENTS

| | | | |
|---|---|---|---|
| 4,059,142 | 11/1977 | Alberny et al. | 164/468 |
| 4,067,378 | 1/1978 | Alberny et al. | 164/468 |

FOREIGN PATENT DOCUMENTS

| | | | |
|---|---|---|---|
| 2423284 | 11/1979 | France | 164/504 |
| 56-148456 | 11/1981 | Japan | 164/468 |
| 2073075A | 10/1981 | United Kingdom | 164/468 |

*Primary Examiner*—Nicholas P. Godici
*Assistant Examiner*—J. Reed Batten, Jr.
*Attorney, Agent, or Firm*—Oblon, Fisher, Spivak, McClelland & Maier

[57] ABSTRACT

An electromagnetic within-mold stirring method and apparatus wherein electromagnetic stirring is imparted to molten steel passing through a mold, under the following conditions where the maximum flux density (in gauss) of a magnetic field induced by an electro-magnetic coil ranges from $1045.e^{-0.16f}$ to $2054.e^{-0.12f}$ (f: frequency, 1–15 Hz) and the place of the maximum magnetic flux density is within the range of 350 mm from the junction between the pouring nozzle and the mold in the direction of drawing of the cast-piece.

4 Claims, 10 Drawing Figures

ELECTROMAGNETIC WITHIN-MOLD STIRRING METHOD OF HORIZONTAL CONTINUOUS CASTING AND AN APPARATUS THEREFOR

BACKGROUND OF THE INVENTION

1. Field of the Invention

The present invention relates to an electromagnetic within-mold stirring method designed to improve the quality of ingots obtained by horizontal continuous casting, and more particularly relates to an electromagnetic within-mold stirring method and an apparatus therefor, designed to minimize occurrence of surface defects such as cold shut and vertical surface cracks.

2. Description of the Prior Art

Intensive studies have been made in various countries for development and practical use of horizontal continuous casting, and investigation has also been made of applying electromagnetic stirring thereto for the same purpose as in secondary cooling zone stirring in vertical continuous casting such as an ordinary upright bending type casting and a curved type continuous casting, that is, for the purpose of increasing the equi-axed crystal zone and remedying central segregation.

For example, Japanese Patent Application Disclosure Nos. 120453/1977, 89829/1978 and 1544/1982 propose methods of stirring molten steel within a mold in horizontal continuous casting.

However, very few can be put to practical use, and electromagnetic stirring has not yet been developed to the extent that its effect can be fully enjoyed. Horizontal continuous casting machines are inevitably operated by intermittent drawing because of their construction being entirely different from that of vertical continuous casting machines, but intermittent drawing entails a surface defect called cold shut, said defect remaining even after rolling. This accounts for the fact that scarfing or cutting of the ingot surface has been practiced with the full knowledge of an inevitable decrease in the yield of good ingots; thus it has been desired to establish measures to prevent occurrence of cold shut itself. Accordingly, a method has been proposed which uses a break ring which causes the inner diameter of the refractory between the mold and the nozzle to approach the inner diameter of the mold. With this method, however, there is a problem in that drawing becomes impossible as the break ring is consumed and thus such is not suitable for a long-term operation. There has also been proposed to increase the drawing cycle so as to decrease the cold shut depth, but the effect of decreasing the cold shut depth is insufficient and there is a disadvantage in that the drawing mechanism becomes too complicated. On the other hand, in the case of horizontal casting of round billets, cooling of the upper and lower surfaces of the billet in the mold tends to be nonuniform, resulting in longitudinal surface cracks in the upper surface, which is insufficiently cooled. However, there has been no report regarding measures to prevent this drawback.

SUMMARY OF THE INVENTION

With this serious situation concerning the prior art problems in mind, the present invention has been accomplished as a result of finding the proper conditions for electromagnetic stirring which are capable of coping with the phenomenon peculiar to horizontal continuous casting. Accordingly, an object of the present invention is to establish conditions for electromagnetic stirring within-mold which are capable of minimizing cold shut and vertical surface cracks which pose a problem to the implementation of horizontal continuous casting. The electromagnetic within-mold stirring method of the present invention which attains said object is characterized in that electromagnetic stirring is imparted to molten steel passing through a mold, under the following conditions: the maximum magnetic flux density (in gauss) of a magnetic field induced by an electromagnetic coil ranges from $1045 \cdot e^{-0.16f}$ to $2054 \cdot e^{-0.12f}$ (f: frequency, 1–15 Hz) and the place of said maximum magnetic flux density is within 350 mm from the junction between the pouring nozzle and the mold in the direction of drawing of the cast-piece.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIGS. 2 through 8 are graphs demonstrating the effectiveness of the present invention, wherein FIGS. 2 and 4 show the relation between drawing cycle and cold shut, FIGS. 3 and 6 show the relation between cold shut and maximum magnetic flux density on the inner wall surface of a mold, FIG. 5 shows the frequency of occurrence of cold shut, FIG. 7 shows the relation between maximum magnetic flux density on the inner wall surface of a mold and longitudinal surface cracks, FIG. 8 shows the relation between frequency and maximum magnetic flux density on the inner wall surface of a mold;

DETAILED DESCRIPTION OF THE PREFERRED EMBODIMENT

Having made a wide study, paying proper attention to cold shut and longitudinal surface cracks brought to the fore as a problem peculiar to horizontal continuous casting, and having found that electromagnetic stirring strength and the position of application of electromagnetic stirring constitute important factors for solving the aforesaid problem, the present invention was completed.

The invention will now be described in more detail following the trail of study.

Figure 1:
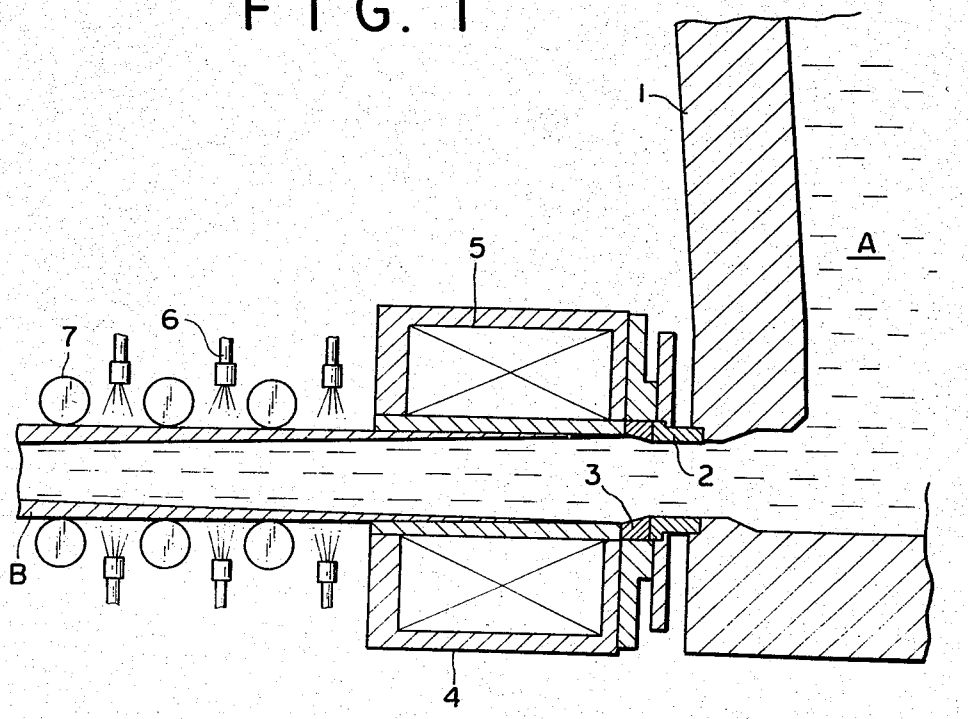
FIG. 1 is a schematic view showing how electromagnetic stirring is implemented.

First, in order to investigate the effect of electromagnetic stirring within a mold, a rotating magnetic field type stirrer was attached to a mold (110 m$^{\phi}$, 110 mm$^{\square}$, 150 mm$^{\phi}$) in a horizontal continuous casting machine, and 0.23% C steel, 0.40% C steel, 0.6% C steel, 1.00% C steel and SUS 304 stainless steel were cast. The frequency was changed between 2 Hz and 10 Hz, the magnetic flux density was changed up to 1300 gauss (max), and the influences of these stirring conditions on the depth and shape of cold shut were investigated. In addition, the drawing speed was 0.5–2.9 m/min. and the drawing cycle was 20–100 cycles/min. The outline of the stirrer attached to the horizontal continuous casting machine is as shown in FIG. 1. As for the reference characters in FIG. 1, A denotes molten steel; 1 denotes a tundish; 2 denotes a nozzle; 3 denotes a break ring; 4 denotes a mold; 5 denotes an electromagnetic stirrer; 6 denotes spray nozzles; 7 denotes guide rollers; and B denotes a bloom.

Figure 2:
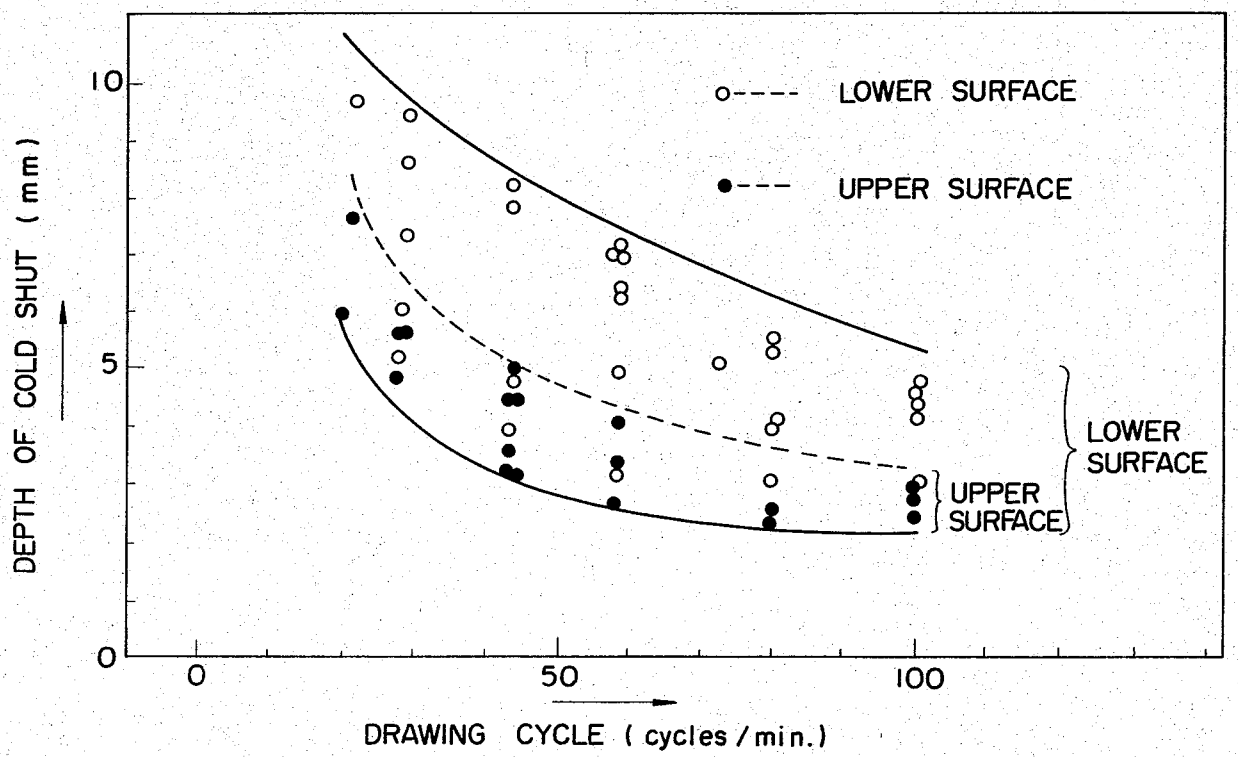

FIG. 2 is a graph showing the relation between the drawing cycle and cold shut, it being seen that as the drawing cycle increases, the cold shut tends to become shallower and that the cold shut in the lower surface of the bloom B is generally deeper than that in the upper surface. This is because with the drawing cycle increasing, the bloom is drawn while the solidified shell is still thin and because the solidification of the lower surface is faster, thus causing cold shut formation. These facts teach that increasing the drawing cycle is a point for shallowing cold shut.

Figure 3:
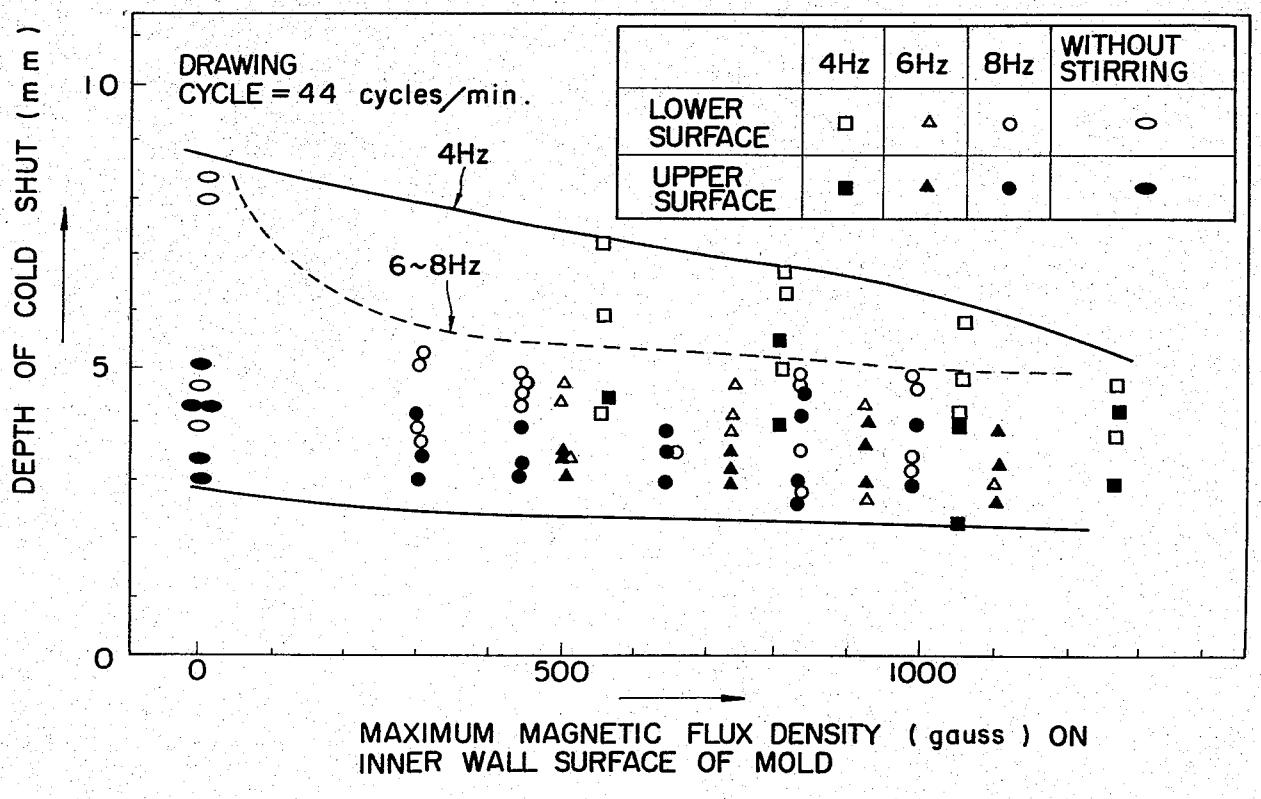

FIG. 3 is a graph showing a variation in cold shut depth caused by within-mold electromagnetic stirring, it being seen that irrespective of the frequency, the cold shut depth tends to be shallower where the magnetic flux density is higher (maximum magnetic flux density in the inner wall surface of the mold), such tendency being more pronounced for 6 Hz and 8 Hz than for 4 Hz. Further, a comparison between the upper and lower surfaces shows that the cold shut in the upper surface tends to be shallower. This is because under the condition where the magnetic flux density is the same, the higher the frequency, the greater the stirring flow rate, thus impeding the formation of cold shut and because the within-mold electromagnetic stirring allows for uniform within-mold cooling so that there is no difference between the upper and lower surfaces. These facts teach that suppressing the growth of solidified shell thickness is an important point for shallowing cold shut.

Figure 4:
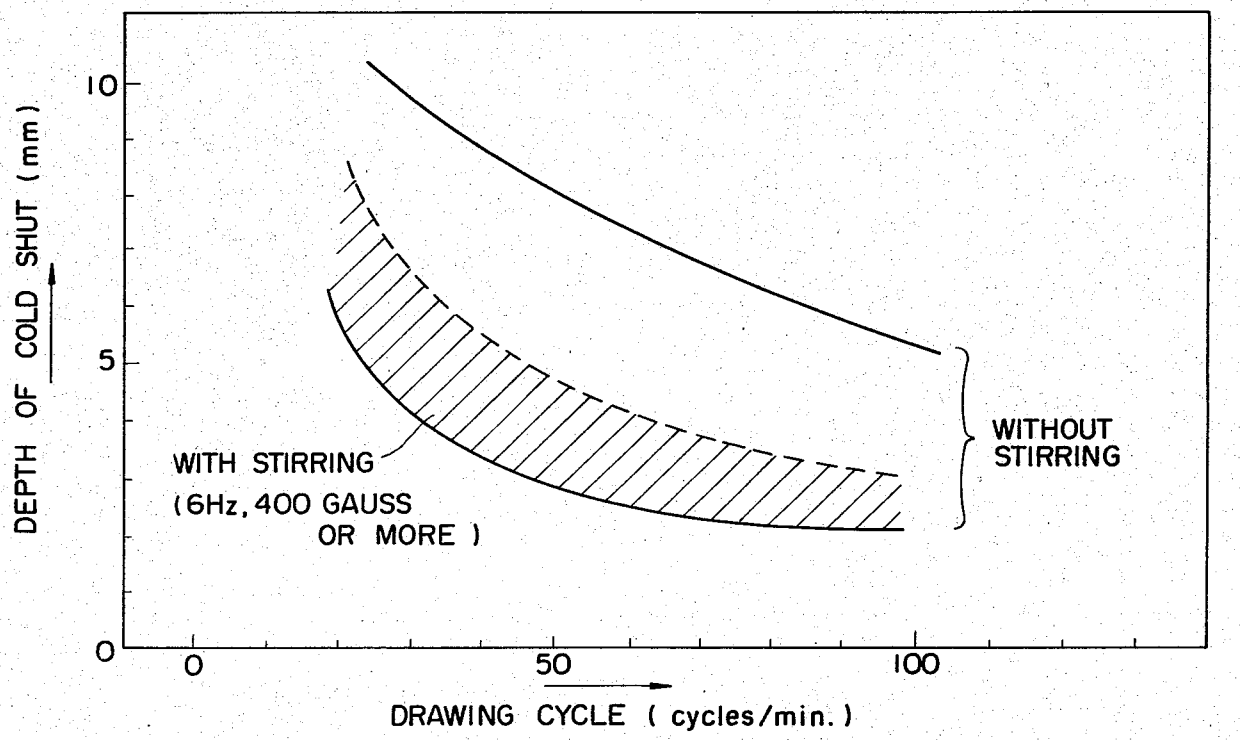

From these findings, a conclusion was drawn that as a means to shallow cold shut it was important to increase the drawing cycle and intensify electromagnetic within-mold stirring and hence an investigation was conducted of the combined influence of these two factors. FIG. 4 shows the result of such investigation. For example, when a group was stirred under the condition of 6 Hz and 400 gauss or more as compared with a non-stirred group, it was seen that there was a tendency that as the drawing cycle increased, the cold shut became remarkably shallower, and it was seen that at a stage of 100 cycles/min., the cold shut depth, which was 2–5.5 mm for the non-stirred group, decreased to 2–3 mm for the stirred group.

Figure 5:
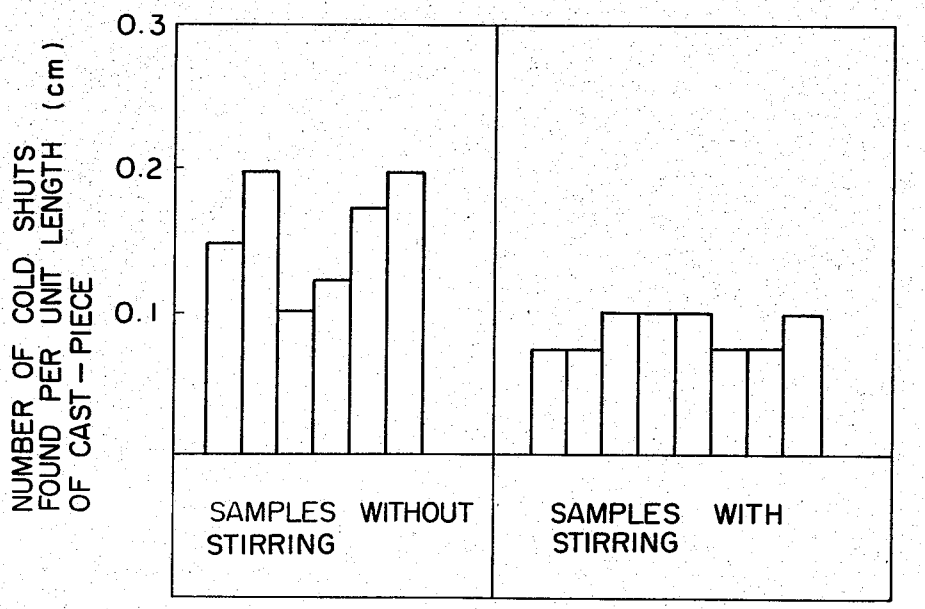
Figure 10:
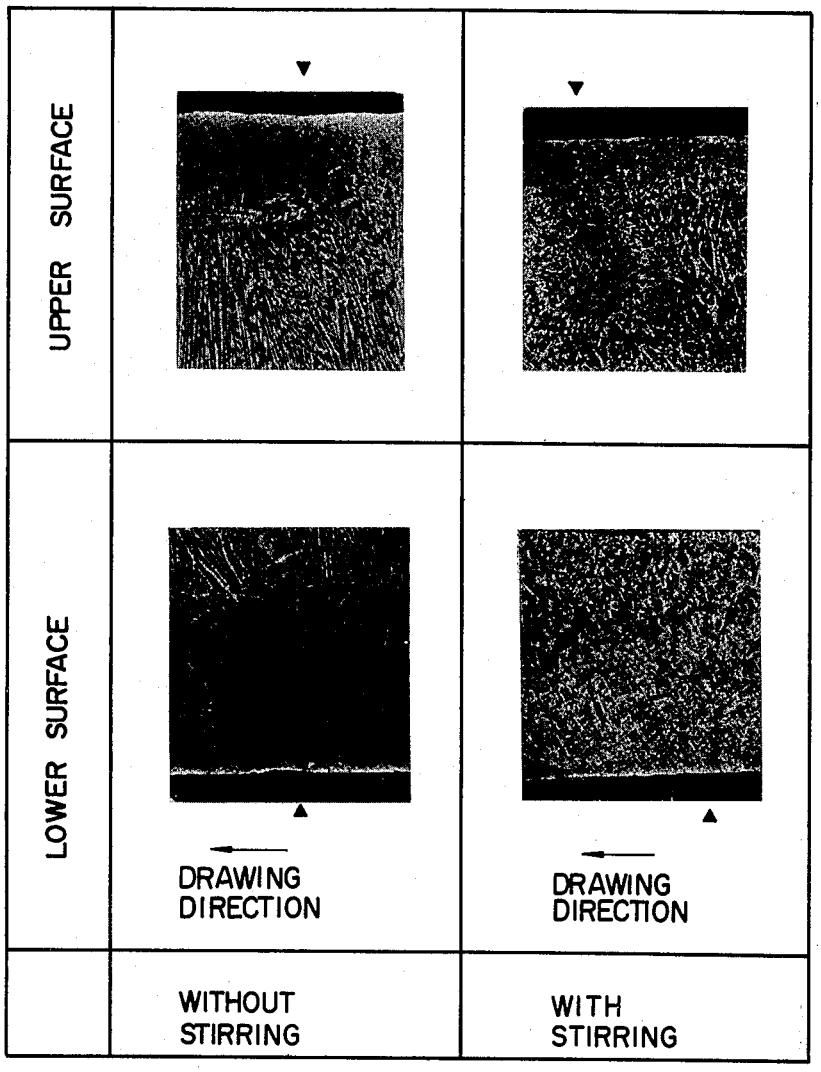
FIG. 10 shows a reference photograph demonstrating the conditions of the upper and lower surface, with and without stirring .

It has been found that the effect of cold shut improvements by the within-mold stirring not only reduces the thickness but also acts on the shape. The reference photographs of FIG. 10 are microphotographs (3× magnification) showing the situation of cold shut, the portions of cold shut being indicated by a black delta mark. In the absence of stirring, cold shut appears as a straight sharp flaw in both upper and lower surfaces, often accompanied by internal cracks in the front end portion, which cause segregation, but in the presence of stirring (8 Hz, 970 gauss), the cold shut is very obscure, not leaving any clear solidification interface. As for the reason therefor, it is believed that the solidification interface is washed by the molten steel flow caused by stirring and part of the solidified shell formed in the early stages of solidification is remelted, mixes with new molten steel entering this portion and solidifies. Where stirring is effected, visual detection of cold shut is very difficult. For example, FIG. 5 shows the number of cold shuts found per unit length (cm) of cast-pipe in horizontal continuous casting with a drawing cycle of 51 cycles/min., making a comparison between a case of no stirring and a case of stirring (6 Hz, 400 gauss or more). Flaws were corroded with hot hydrochloric acid to facilitate detection, but it is seen that the percentage detection is low for each sample where stirring is effected, a fact which conforms to the considerations described above.

Although the effect of cold shut improvements by stirring has thus been ascertained, the contents and extent of improvements are not uniform. For example, in the case of a frequency of 6 Hz, the effect of improvements by stirring develops in approximate proportion until a magnetic flux density of 400 gauss, but even if the magnetic flux density is increased to above 400 gauss, no corresponding increase in the effect appears. Thus, it is necessary to find some upper limit in consideration of economic merits.

As for the concentrations of the alloy components in a shell subjected to the flow of molten steel in the course of solidification, it is known that if the equilibrium distribution coefficient of said alloy components is less than 1, negative segregation takes place and if it is above 1, positive segregation takes place. However, since the equilibrium distribution coefficient of such principal alloying elements as C, Si, Mn, P and S is less than 1, negative segregation takes place. Particularly, negative segregation due to C adversely affects hardenability. Thus it is necessary that the degree of negative segregation given by the following formula be 0.10 or less.

$$\text{Degree of negative segregation} = \frac{\left(\begin{array}{c}\text{Average concentration}\\ \text{of C in steel}\end{array}\right) - \left(\begin{array}{c}\text{Concentration of C in zone}\\ \text{of negative segregation}\end{array}\right)}{\text{Average concentration of C in steel}}$$

Figure 6:
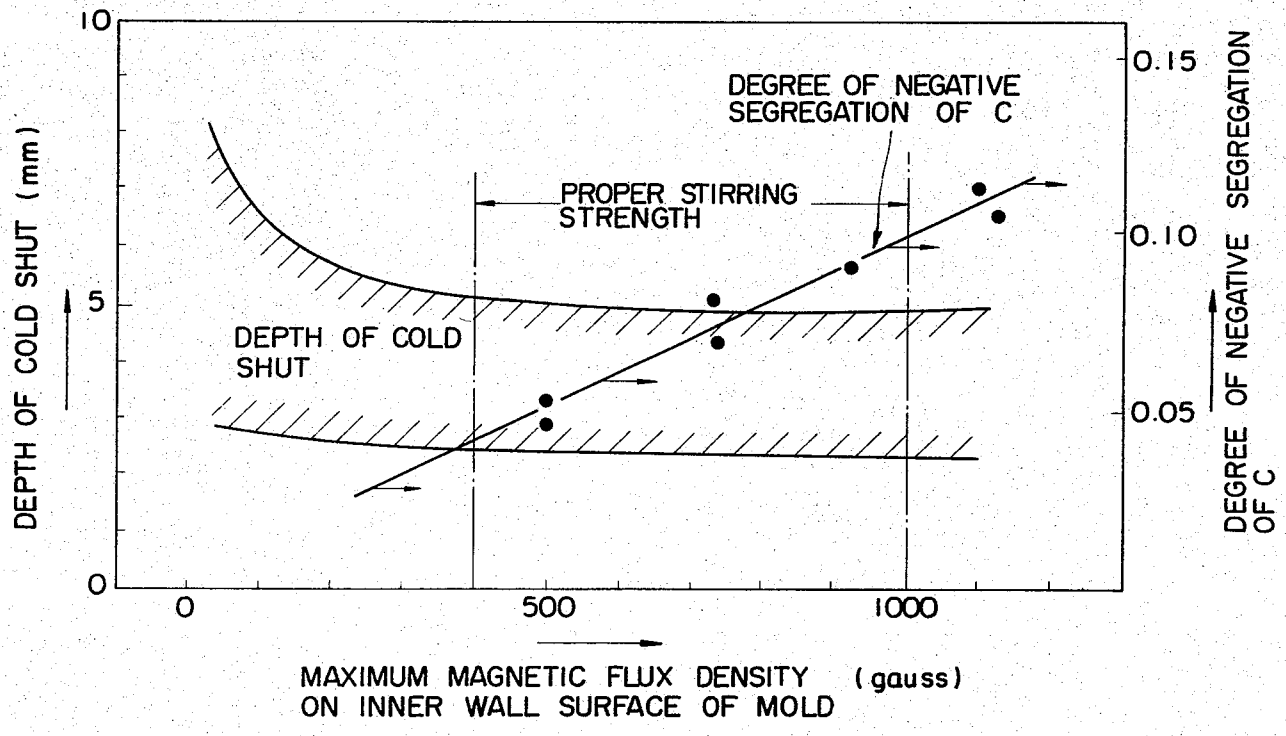

From the standpoint of reducing negative segregation, excessive stirring must be avoided, and it was thought necessary to determine the upper limit of the stirring force. Accordingly, the relation between C and the degree of negative segregation was investigated by maintaining the frequency at 6 Hz and changing the magnetic flux density so as to change the stirring force. The result is shown in FIG. 6. If the magnetic flux density exceeds 1000 gauss, the degree of negative segregation exceeds 0.10; thus it is necessary that said density be 1000 gauss or less. Further, if the density is less than 400 gauss, this often results in the cold shut becoming deeper; thus the density must be 400 gauss or more before the effect of cold shut improvements can be ensured. Thus, it has been found that there is a region in which cold shut improvements and minimization of negative segregation can be attained at the same time.

Figure 7:
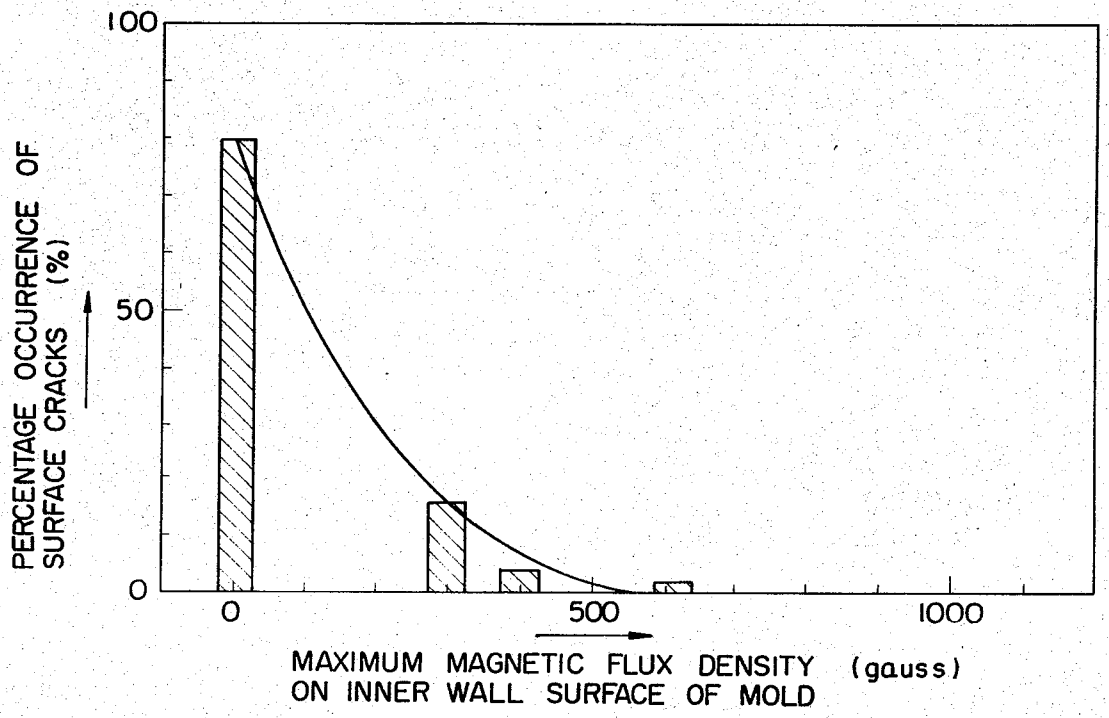

FIG. 7 is a graph showing the relation between stirring and longitudinal cracks, illustrating the situation of longitudinal cracks in the surface of a round billet when the magnetic flux density is changed at a frequency of 6 Hz, it being seen that longitudinal surface cracks are remedied as the magnetic flux density is increased. This effect is more pronounced than the effect of cold shut improvements and when the magnetic flux density exceeds 400 gauss, cracks are almost zero. Therefore, it has been found that the proper stirring region provided by FIG. 6 is also effective against vertical surface cracks. It is believed that the cause of longitudinal surface cracks is the nonuniform solidification of the upper and lower surfaces, and it seems that enhancement of uniform solidification has led to prevention of vertical surface cracks.

Figure 8:
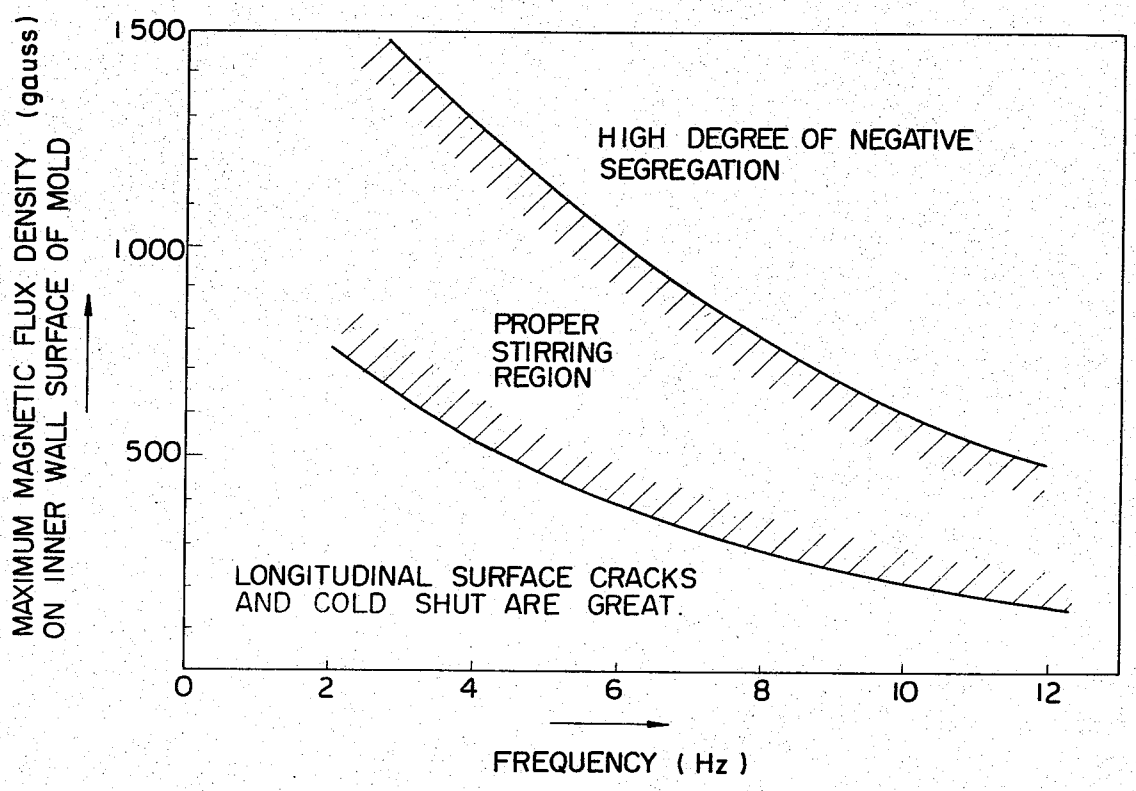

In the experiments described above, the frequency was 6 Hz. Next time, an attempt was made to find the proper magnetic flux density range while changing the frequency. The result is shown in FIG. 8. The region at the upper right in FIG. 8 is where negative segregation is too high, and the region at lower left is also unsuitable since cold shut and vertical surface cracks manifest themselves plainly. Thus, only the central region marked with diagonal lines is the suitable stirring region, which can be expressed by the following relation between frequency and magnetic flux density.

$$1045 \cdot e^{-0.16f} \leqq G \leqq 2054 \cdot e^{-0.12f}$$

where

G: magnetic flux density (in gauss)

f: frequency of 1–15 Hz

It has been ascertained that this relation is applicable to various types of steel including carbon steels and stainless steels. The reason whey the lower limit of frequency is 1 Hz is that if it is less than 1 Hz the stirring becomes insufficient, while if it exceeds 15 Hz attenuation becomes noticeable in molten steel, resulting in stirring of only the surface, so that the cold shut preventing effect cannot be fully developed.

The proper position for installing the electromagnetic stirring coil will now be described.

Figure 9:
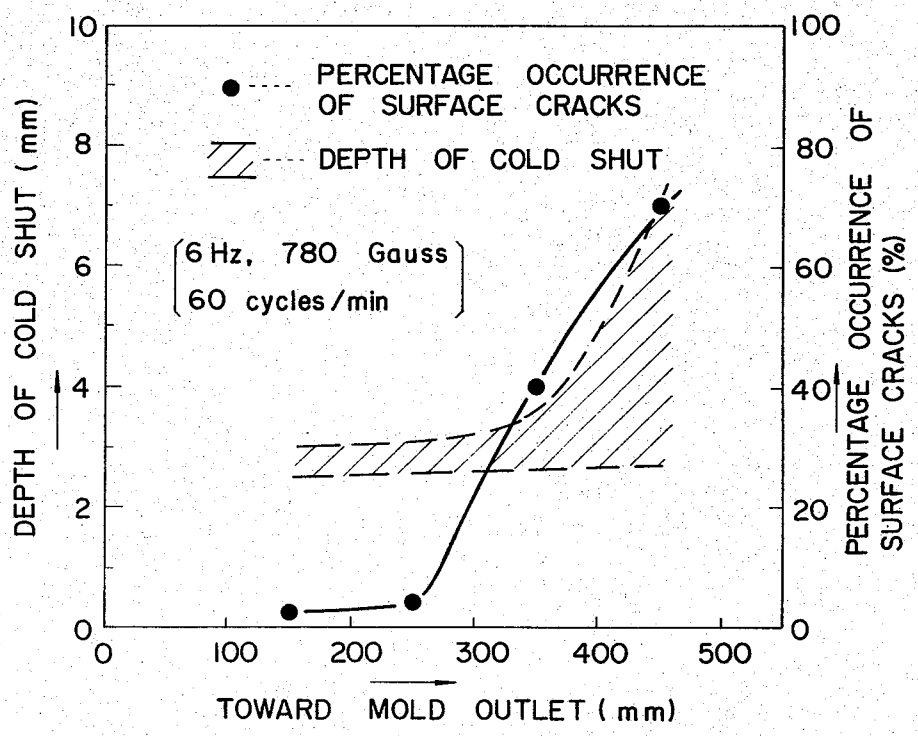
FIG. 9 shows the relation between cold shut depth, percentage occurrence of surface cracks and the position of maximum electromagnetic stirring strength.

FIG. 9 shows the influence of a maximum electromagnetic stirring strength position on cold shut and cast-piece surface cracks when the position of the electromagnetic coil 5 in the continuous casting equipment shown in FIG. 1 is moved along the lateral surface of the mold 4.

In this embodiment, a magnetic field with a flux density of 780 gauss at a frequency of 6 Hz is used. The drawing of the cast-piece in this case is effected at 60 cycles/min. As is clear from this figure, if the electromagnetic coil is installed so that the position of maximum magnetic flux density is within 350 mm, preferably 200 mm from the junction between the coil 5 and the nozzle 2 in the direction of drawing of the cast-piece, desirable improvements in both cold shut and surface cracks can be obtained. Thus, placing the electromagnetic coil within this range results in applying desired stirring to molten steel in the vicinity of the break ring 3, thereby remarkably remedying cold shut and surface cracks. Placement outside this range would weaken the molten steel flow in the vicinity of the break ring 3, failing to remedy cold shut and surface cracks.

As for the direction of electromagnetic stirring, the flow of molten metal may always be in a definite direction, but there are cases where intermittent forward and backward rotation or intermittent rotation irrespective of its direction is useful in increasing the effectiveness of the present invention. Further, the electromagnetic stirring coil may be attached to one or each of the upper and lower surfaces of the cast-piece but its attachment to the lower surface will provide greater effect.

The present invention is arranged in the manner described so far and is capable of decreasing cold shut and surface cracks peculiar to horizontal continuous casting and minimizing the occurrence of negative segregation, thus breaking through the important bottleneck to practical use of horizontal continuous casting.

Obviously, numerous modifications and variations of the present invention are possible in light of the above teachings. It is therefore to be understood that within the scope of the appended claims, the invention may be practiced otherwise than as specifically described herein.

What is claimed is:

1. An electromagnetic within-mold stirring method used in a horizontal continuous casting apparatus including a tundish, a pouring nozzle, a mold connected to said pouring nozzle, and an electromagnetic coil disposed around said mold, for electromagnetically stirring molten steel passing through said mold by a magnetic field established by said electromagnetic coil, which comprises:

inducing a magnetic field by an alternating current with a frequency f of 1–15 Hz and a maximum magnetic flux density G within the range from $1045 \cdot e^{-0.16f}$ to $2054 \cdot e^{-0.12f}$; and locating a position where said maximum magnetic flux density is produced within 350 mm from a junction between said pouring nozzle and said mold in a direction of drawing a cast-piece.

2. An electromagnetic within-mold stirring method as set forth in claim 1, wherein said step of locating the position of maximum magnetic flux density includes the step of locating the maximum flux density within 200 mm from said junction between said pouring nozzle and said mold in said direction of drawing said cast-piece.

3. An electromagnetic within-mold stirring method as set forth in claim 1, which further includes the step of inductively stirring said molten steel within the mold around an axis of the mold by said magnetic field.

4. A horizontal continuous casting apparatus, comprising:

a tundish;

a pouring nozzle;

a mold connected to said pouring nozzle; and electromagnetic coil means disposed around said mold for inducing a maximum magnetic flux density of a magnetic field between $1045 \cdot e^{-0.16f}$ and $2054 \cdot e^{-0.12f}$ wherein f denotes a frequency of 1–15 Hz and wherein said electromagnetic coil means is disposed around said mold such that a position where said maximum magnetic flux density is produced is located within 350 mm from a junction between said pouring nozzle and said mold in a direction of drawing of a cast-piece.

* * * * *